US009305414B2

(12) United States Patent
Kimoto et al.

(10) Patent No.: US 9,305,414 B2
(45) Date of Patent: Apr. 5, 2016

(54) SAFE UNLOCKING MACHINE

(71) Applicant: LECIP HOLDINGS CORPORATION, Motosu-shi, Gifu-ken (JP)

(72) Inventors: Kenji Kimoto, Motosu (JP); Takeshi Matsuno, Motosu (JP)

(73) Assignee: LECIP HOLDINGS CORPORATION, Gifu-ken (JP)

( * ) Notice: Subject to any disclaimer, the term of this patent is extended or adjusted under 35 U.S.C. 154(b) by 0 days.

(21) Appl. No.: 14/410,885

(22) PCT Filed: Jul. 1, 2013

(86) PCT No.: PCT/JP2013/068044

§ 371 (c)(1),
(2) Date: Dec. 23, 2014

(87) PCT Pub. No.: WO2014/007214

PCT Pub. Date: Jan. 9, 2014

(65) Prior Publication Data

US 2015/0170450 A1 Jun. 18, 2015

(30) Foreign Application Priority Data

Jul. 6, 2012 (JP) ..... 2012-152580

(51) Int. Cl.

| | |
|---|---|
| ***G07D 11/00*** | (2006.01) |
| ***E05G 1/02*** | (2006.01) |
| ***E05G 7/00*** | (2006.01) |

(52) U.S. Cl.

CPC ..... *G07D 11/0009* (2013.01); *E05G 1/02* (2013.01); *E05G 7/00* (2013.01); *G07D 11/0036* (2013.01)

(58) Field of Classification Search

CPC ..... G07D 11/0009; G07D 11/0036; G07D 11/0081; G07D 11/0048; G07F 9/06; E05B 65/0075; E05G 1/02; E05G 1/04; E05G 7/00; B65H 2701/1912

USPC ..... 232/15, 16, 1 D, 44, 43.2; 109/55, 47, 109/24.1; 194/350, 351; 700/225

See application file for complete search history.

(56) References Cited

U.S. PATENT DOCUMENTS 4,380,316 A 4/1983 Glinka et al.
6,854,640 B2 * 2/2005 Peklo ..... G07F 9/06 194/351

(Continued)

FOREIGN PATENT DOCUMENTS

JP 9-128586 A 5/1997
JP 2006-342540 A 12/2006

(Continued)

OTHER PUBLICATIONS

An English translation of the International Preliminary Report on Patentability relating to U.S. Appl. No. 14/410,885, filed Dec. 23, 2014, 6 pages.

(Continued)

*Primary Examiner* — William Miller

(74) *Attorney, Agent, or Firm* — Kilpatrick Townsend & Stockton LLP

(57) ABSTRACT

A safe unlocking machine includes a currency container that may be moved into and out of a container unit. The currency container includes a coin inlet, a bill inlet, and a lock-incorporated shutter that opens and closes a tag. When the shutter is operated to open, RFID wireless verification is performed between an antenna located in the container unit and the tag of the currency container. When predetermined conditions including accomplishment of the RFID verification are satisfied, rotation of a receiver handle is permitted. When the receiver handle is rotated once, a safe main body of a safe, which is located in the safe unlocking machine, is solely moved rearward. The currency in the safe main body falls down due to its own weight and is stored in the currency container.

3 Claims, 6 Drawing Sheets

(56) References Cited

U.S. PATENT DOCUMENTS

| | | | | |
|---|---|---|---|---|
| 7,243,773 | B2 * | 7/2007 | Bochonok | G07F 9/06 188/5 |
| 7,857,198 | B2 * | 12/2010 | Bell | B65H 1/26 109/38 |
| 8,393,455 | B2 * | 3/2013 | Blake | G07D 3/00 109/53 |
| 9,092,924 | B1 * | 7/2015 | Rasmussen | G07D 3/00 |
| 2007/0226142 | A1 * | 9/2007 | Hanna | G06Q 20/105 705/41 |
| 2008/0135608 | A1 * | 6/2008 | Ireland | B32B 27/36 232/1 D |
| 2015/0083792 | A1 * | 3/2015 | Bullock | G07D 11/0009 232/1 D |
| 2015/0225992 | A1 * | 8/2015 | Taki | G07D 11/0006 109/24.1 |

FOREIGN PATENT DOCUMENTS

| | | |
|---|---|---|
| JP | 2007-328698 A | 12/2007 |
| JP | 2011-221918 A | 11/2011 |

OTHER PUBLICATIONS

International Search Report for PCT/JP2013/068044, dated Sep. 18, 2013, two pages.

* cited by examiner

SAFE UNLOCKING MACHINE

TECHNICAL FIELD

The present invention relates to a safe unlocking machine that receives and collects currency or the like from a plurality of safes in a centralized manner.

BACKGROUND ART

In the prior art, a known safe unlocking machine collects currency (coins, bills, and the like) from safes of fareboxes (refer to, for example, patent document 1). Each safe includes a safe main body, which stores currency, and a lock-incorporated safe door, which closes an opening of the safe main body through which the currency is accessed. The safe is attached to a farebox main body in a removable manner. The safe door is closed and locked when the safe is removed from the farebox. When the safe unlocking machine collects the currency from the safe, for example, the safe is turned upside down and set in the safe unlocking machine. The safe unlocking machine unlocks the safe door. By moving only the safe main body while keeping the safe door at the same position, the currency falls from the safe into a currency container of the safe unlocking machine. This task is performed on each safe. The safe unlocking machine stores currency from a plurality of safes in a centralized manner.

The currency container is movable into and out of the safe unlocking machine main body so that the currency, which has been collected in a centralized manner, can be removed. When resetting the currency container in the safe unlocking machine main body, the currency container may be improperly set in a safe unlocking machine main body that differs from the one to which the currency container was attached to before. For example, patent document 2 discloses a technique for performing verification between the safe unlocking machine main body and the currency container. In the technique of patent document 2, the safe unlocking machine main body and the currency container are connected by an electrical contact to perform encryption communication. When the container unit is correctly recognized, currency collection in the container unit is permitted.

PRIOR ART DOCUMENTS

Patent Documents

Patent Document 1: Japanese Laid-Open Patent Publication No. 9-128586

Patent Document 2: U.S. Pat. No. 4,380,316

SUMMARY OF THE INVENTION

Problems that are to be Solved by the Invention

Patent document 2 performs verification between the safe unlocking machine main body and the currency container at the electrical contact. Thus, two members are in electrical contact. This causes wear at the location of contact in the two members and adversely affects durability. Additionally, patent document 2 employs a structure that exposes the contact locations to the exterior. This affects water resistance.

It is an object of the present invention to provide a safe unlocking machine that ensures high durability.

Means for Solving the Problem

One aspect of the present invention is a safe unlocking machine. The safe unlocking machine receives a safe, which stores a stored article, unlocks the safe, and opens a door of the safe to collect the stored article from the safe. The safe unlocking machine includes a storage container, a safe unlocking machine main body configured to receive the storage container, a verification unit that performs verification between the storage container and the safe unlocking machine main body through short-distance communication, and a control unit that permits the stored article to be collected in the storage container when the verification performed by the verification unit is accomplished.

Effects of the Invention

The present invention ensures a safe unlocking machine high durability.

BRIEF DESCRIPTION OF THE DRAWINGS

FIG. 2 shows the structure of a lock-incorporated safe, in which

FIG. 5 shows a closed state of a lock-incorporated shutter, in which

FIG. 6 shows an open state of the lock-incorporated shutter, in which

EMBODIMENTS OF THE INVENTION

One embodiment of the present invention will now be described with reference to FIGS. 1 to 7.

Safe Unlocking Machine Schematic Structure

Figure 1:
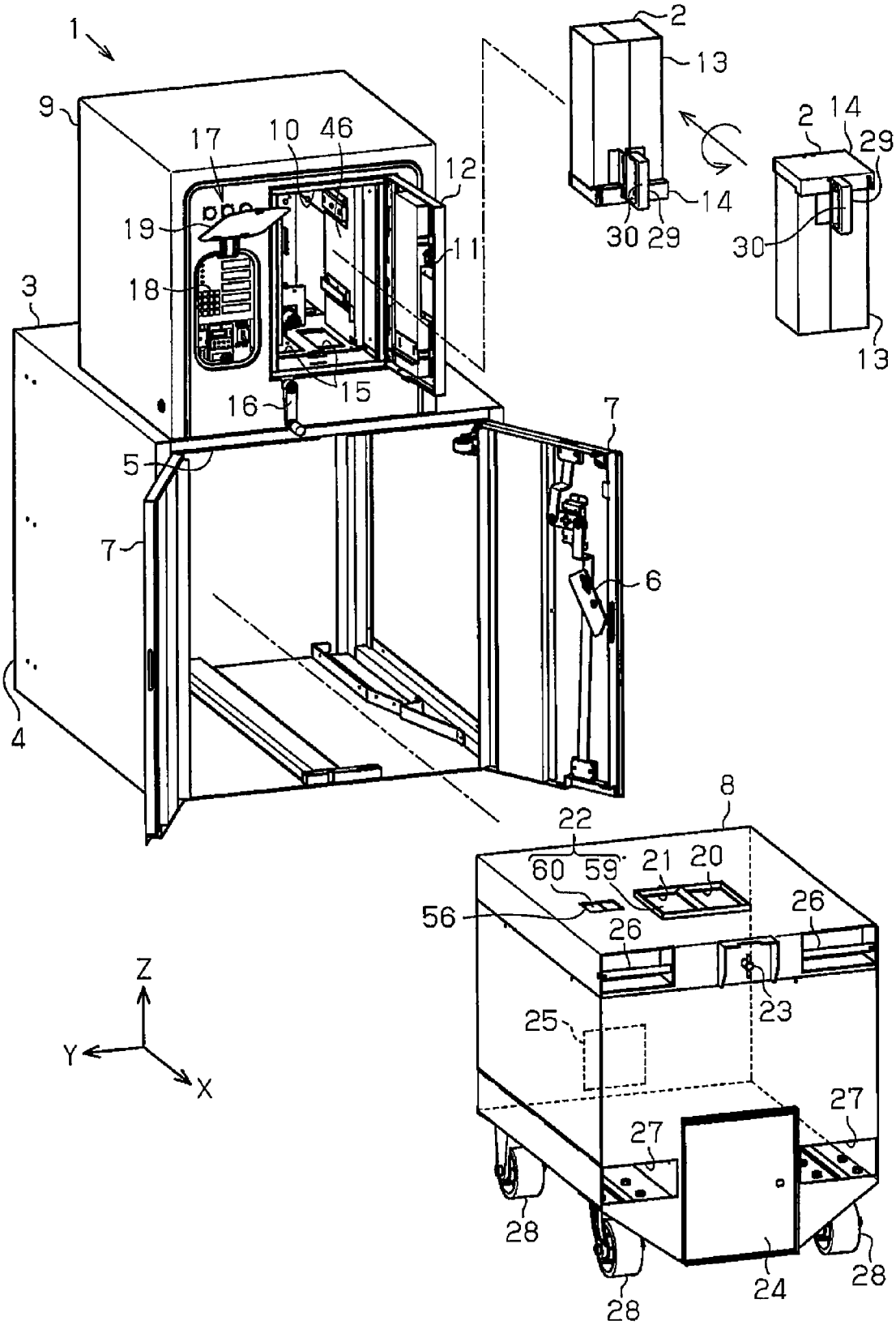
FIG. 1 is a perspective view showing the external appearance of one embodiment of a safe unlocking machine.

As shown in FIG. 1, a safe unlocking machine 1 is a cash collection machine that collects currency (coins and bills) in a centralized manner from a number of safes 2, which are removed from a number of fareboxes (not shown). The safe unlocking machine 1 includes a container unit 3 that stores the collected currency in a centralized manner. The container unit 3 includes a housing 4, a container accommodation portion 5 located inside the housing 4, and a housing door 7 located at the front side of the housing 4 to open and close the container accommodation portion 5. The container accommodation portion 5 accommodates a currency container 8, which receives the currency. The currency container 8, which is a currency storage box having a large volume, may be moved into and out of the container accommodation portion 5. The housing door 7 includes a lock 6 to lock the housing door 7.

A receiver 9 is located above the container unit 3. The receiver 9 accommodates the safe 2 and unlocks the accommodated safe 2 to discharge currency out of the safe 2 and into the container unit 3. A receiver door 12 is located at the front side of the receiver 9 to open and close a safe accommodation portion 10. The receiver door 12 includes a lock 11 to lock the receiver door 12. The safe 2 includes a safe main body 13, which stores currency, and a safe door 14, which opens and closes an opening of the safe main body 13. When the safe 2 is accommodated in the safe accommodation portion 10, the safe 2 is turned upside down, that is, the safe door 14 faces downward. Two chutes 15 are arranged at a bottom side of the safe main body 13. The two chutes 15 guide the currency from the safe 2 to the currency container 8.

A rotatable receiver handle 16 is located at the front side of the receiver 9. When the receiver handle 16 is rotated, the safe main body 13 of the safe 2, which is set in the safe accommodation portion 10, is solely moved toward the rear of the receiver 9. The receiver handle 16 may be capable of being fully rotated once (360 degrees) from an initial position. The receiver handle 16 is configured so that a latch coupled to the receiver handle 16 holds the receiver handle 16 until the receiver handle 16 is rotated to the final position. In other words, the receiver handle 16 is configured to return to the initial position only when the receiver handle 16 is rotated to the final position.

An indicator 17 is located at the front side of the receiver 9. The indicator 17 indicates the operation of the safe unlocking machine 1. The indicator 17 includes, for example, LEDs that notify an operator of a normal state, a currency receiving state, an error, and the like. An operation panel 18 and a lock-incorporated door 19 are located at the front side of the receiver 9. The operation panel 18 is operated to change the setting of the safe unlocking machine 1. The lock-incorporated door 19 opens and closes the operation panel 18. This structure allows only a manager to operate the operation panel 18.

A coin inlet 20 and a bill inlet 21 are arranged side by side in an upper surface of the currency container 8. The coin inlet 20 and the bill inlet 21 share a shutter 22 that opens and closes the inlets. A container handle 23 is located at the front side of the currency container 8. The container handle 23 is operated to open and close the shutter 22. The container handle 23 is slidable in a device-depth direction (X-axis direction of FIG. 1). When pushed to the front surface of the currency container 8, the container handle 23 can be rotated by approximately 90 degrees.

A lock-incorporated bill removal door 24, two grips 26, and two insertion holes 27 are arranged at the front side of the currency container 8. Attachments of a forklift are inserted into the two insertion holes 27. A lock-incorporated coin discharge opening door 25 is arranged at the rear of the currency container 8. Four casters 28 are located on a bottom side of the currency container 8.

Safe Structure

Figure 2A:
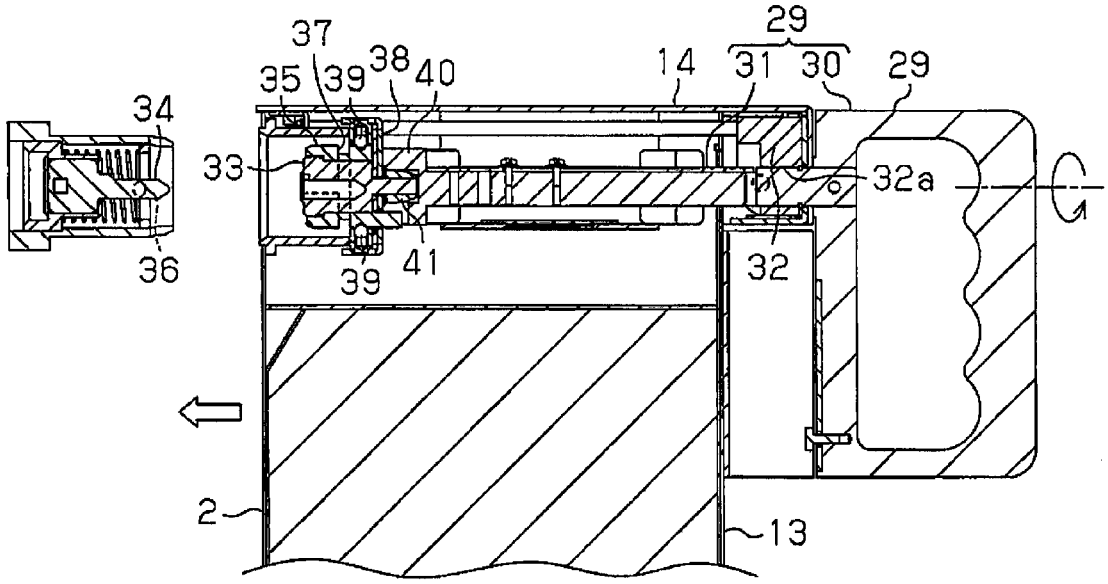
FIG. 2A is a cross-sectional view when the lock-incorporated safe is locked.
Figure 2B:
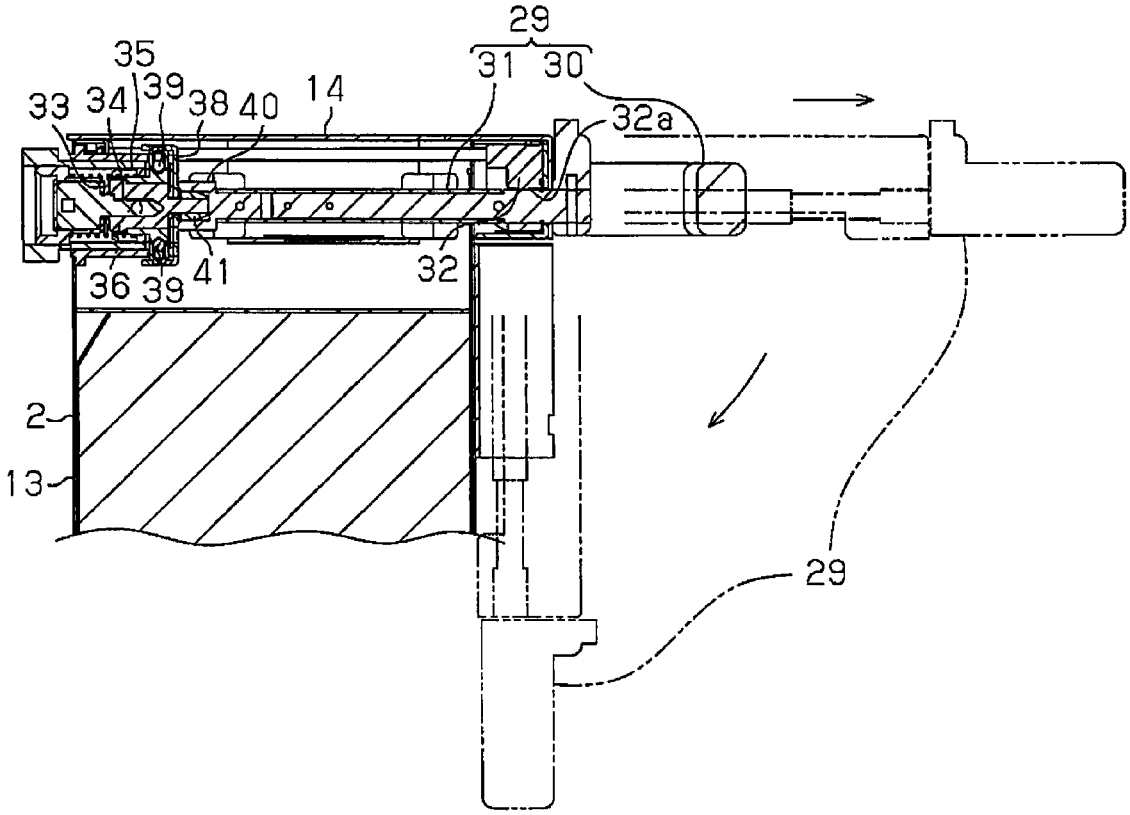
FIG. 2B is a cross-sectional view when the lock-incorporated safe is unlocked.

As shown in FIGS. 2A and 2B, a safe handle 29 is attached to the safe door 14. The safe handle 29 is operated to open and close the safe door 14. The safe handle 29 includes a grip 30 and a shaft 31. The shaft 31 is slidably inserted into a block 32 of the safe main body 13. A bearing 32*a* of the block 32 allows the safe handle 29 to be rotated about the shaft 31. The bearing 32*a* of the block 32 also allows the safe handle 29 to be slidable, together with the safe door 14, between an open position where the safe door 14 opens and a closed position where the safe door 14 closes by. When the safe handle 29 is pulled to the open position to open the safe door 14, the block 32 may be rotated about an axis orthogonal to the sliding direction of the safe door 14 together with the safe door 14 and the safe handle 29.

A cylinder lock 33, which is located at the rear of the safe main body 13, functions as a lock of the safe door 14. A rotation piece 35 is attached to the circumference of the cylinder lock 33. When an authentic key plate 34 is inserted into the cylinder lock 33, the rotation piece 35 rotates integrally with the cylinder lock 33. An engagement groove 37 is recessed throughout the circumference of the rotation piece 35 in the circumferential direction. The engagement groove 37 may be engaged with a projection 36 of the key plate 34. Two detent portions 39 are located in a support frame portion 38, which has a generally ring-like shape, to perform a detent operation on the rotation piece 35. When the safe handle 29 slides to the closed position to close the safe door 14, a shaft engagement portion 41 of the cylinder lock 33 is inserted into an engagement recess 40 at the distal end of the shaft 31 and engaged with the engagement recess 40. This allows for integral rotation of the shaft 31 and the cylinder lock 33.

As shown in FIG. 2A, when the safe handle 29 is oriented in the vertical direction and slides to the closed position to close the safe door 14 and the key plate 34 is not inserted into the cylinder lock 33, the cylinder lock 33 cannot be rotated. Therefore, when the safe handle 29 is oriented in the vertical direction and fixed to the safe main body 13, the safe door 14 is locked. During transportation of the safe 2, the safe door 14 is closed and locked. Thus, the safe door 14 would not be opened in an unauthorized manner.

As shown in FIG. 2B, if the key plate 34 is inserted into the cylinder lock 33 when setting the safe 2 in the farebox or the like, the cylinder lock 33 is unlocked. As a result, the cylinder lock 33 and the rotation piece 35 become rotatable. That is, the safe handle 29 may be rotated. The safe handle 29 is rotated from a fixed position by approximately 90 degrees. The rotated safe handle 29 slides toward a side opposite to the currency container 8. This opens the safe door 14. When the safe handle 29 slides to the open position to open the safe door 14, the safe door 14 becomes rotatable together with the block 32. This allows the safe door 14 to be tilted 90 degrees from a horizontal position. When the safe handle 29 is rotated to an unlocking side, the engagement groove 37 is engaged with the projection 36. This fixes the safe 2 to the farebox.

Structures of Receiver and Container Unit

Figure 3:
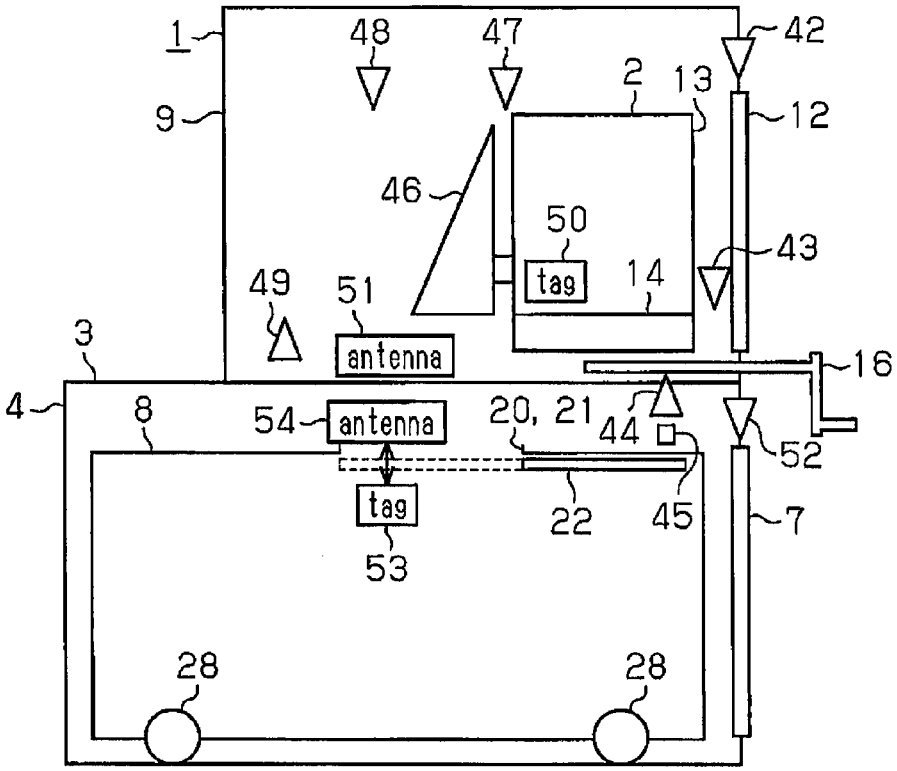
FIG. 3 is a schematic diagram of the safe unlocking machine after the safe is set and before a receiver handle is rotated.
Figure 4:
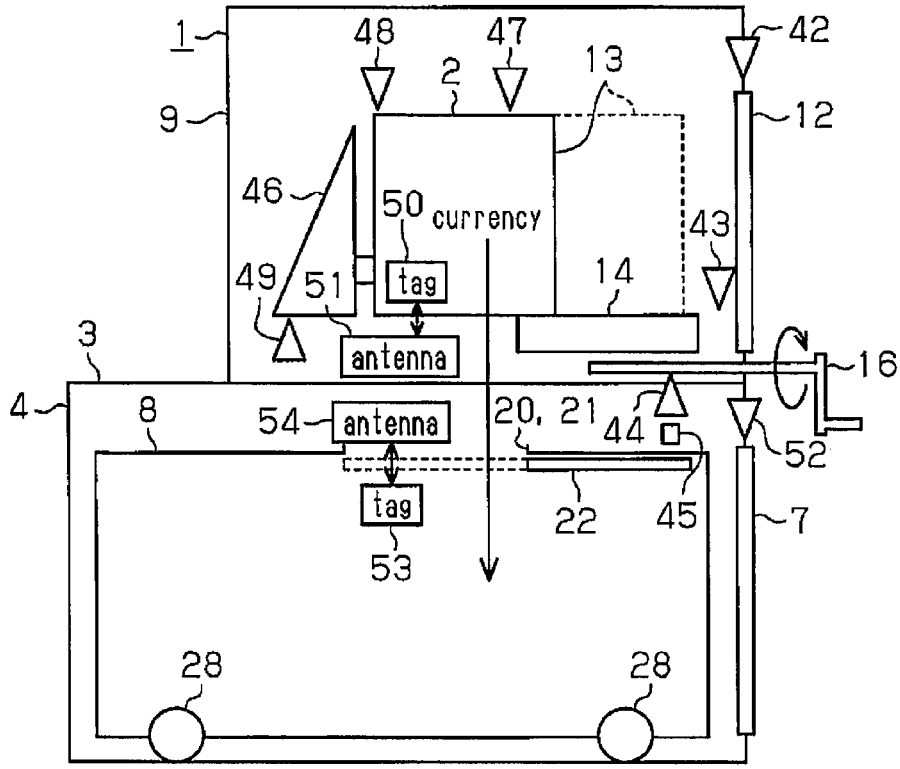
FIG. 4 is a schematic diagram of the safe unlocking machine after the safe is set and the receiver is rotated.

As shown in FIGS. 3 and 4, the receiver 9 includes a receiver door detection sensor 42 and a safe detection sensor 43. The receiver door detection sensor 42 detects the opening and closing of the receiver door 12, which is opened and closed with the lock 11. The safe detection sensor 43 detects whether or not the safe 2 is set in the safe accommodation portion 10. Further, the safe detection sensor 43 detects whether or not the safe handle 29 has been oriented from the vertical direction to an unlocking direction, that is, whether or not the safe handle 29 has been rotated by approximately 90 degrees from the fixed position to be horizontal. The receiver door detection sensor 42 and the safe detection sensor 43 each include a photosensor.

The receiver 9 includes a handle fixing solenoid 44, which limits the rotation of the receiver handle 16. The handle fixing solenoid 44 includes, for example, an attraction solenoid (pull solenoid). When the handle fixing solenoid 44 is energized, a plunger moves away from the receiver handle 16. This allows for rotation of the receiver handle 16. The handle fixing solenoid 44 includes a solenoid driving state detection sensor 45, which detects the driving state (lock or unlock) of the handle fixing solenoid 44. The solenoid driving state detection sensor 45 includes, for example, a photosensor.

The receiver 9 includes a rear movable portion 46. When the receiver handle 16 is rotated, the rear movable portion 46 moves only the safe main body 13 of the safe 2, which is set in the safe accommodation portion 10, toward the rear side of the receiver 9. The rear movable portion 46 is located at a home position when attached to the safe accommodation portion 10. When the receiver handle 16 is rotated once, the rear movable portion 46 moves from a home position to a final position in cooperation with the rotation of the receiver handle 16. The receiver 9 includes a home position detection sensor 47, which detects that the rear movable portion 46 is located at the home position, and a final position detection sensor 48, which detects that the rear movable portion 46 is located at the final position. The home position detection sensor 47 and the final position detection sensor 48 may each include a photosensor.

The receiver 9 includes a lock solenoid 49, which keeps the safe main body 13 at the final position. The lock solenoid 49 includes, for example, an attraction solenoid (pull solenoid). At the final position, the rear movable portion 46 is engaged with the lock solenoid 49. This stops the rear movable portion 46 at the final position. When the lock solenoid 49 is energized to draw in the plunger, the rear movable portion 46 moves from the final position to the home position.

The safe 2 includes a tag 50, which performs verification with the receiver 9 through short-distance communication in which communication is performed with a close range. The receiver 9 includes an antenna 51, which performs short-distance communication with the tag 50. Using electric waves received from the antenna 51 as a power source, the tag 50 performs bidirectional communication with the antenna 51 through load modulation. The tag 50 stores an identification ID, which is unique to the tag (unique to the safe). For example, radio frequency identification (RFID) is used for the short-distance communication. When the power of the safe unlocking machine 1 goes on, the antenna 51 performs a polling operation. When the communication is established with the approaching tag 50, the antenna 51 performs verification communication with tag 50 through load modulation.

The container unit 3 includes a housing door detection sensor 52, which detects the opening and closing of the housing door 7. The housing door detection sensor 52 includes, for example, a photosensor.

Currency Container Verification Function

As shown in FIGS. 3 and 4, the container unit 3 and the currency container 8 have a verification function (currency container verification function), which verifies whether or not the authentic currency container 8 is set in the container unit 3 using the short-distance communication. In the present example, the currency container verification function uses the RFID in the same manner as the safe 2. The currency container 8 includes a tag 53. A unique (unique to currency container) identification ID is stored in the tag 53. The tag 53 forms a unit and has a water resistant structure. The container unit 3 includes an antenna 54 used for the short-distance communication.

When the power of the safe unlocking machine 1 goes on, the antenna 54 starts a polling operation. The antenna 54 periodically transmits electric waves to monitor whether or not the tag 53 is approaching the safe unlocking machine 1. When receiving a polling electric wave from the antenna 54, the tag 53 transmits the identification ID stored in the tag 53 through load modulation. When receiving the identification ID from the tag 53 with the antenna 54, the safe unlocking machine 1 performs verification on the received identification ID. In accordance with the verification result, the safe unlocking machine 1 permits rotation of the receiver handle 16.

Currency Container Structure

Figure 5B:
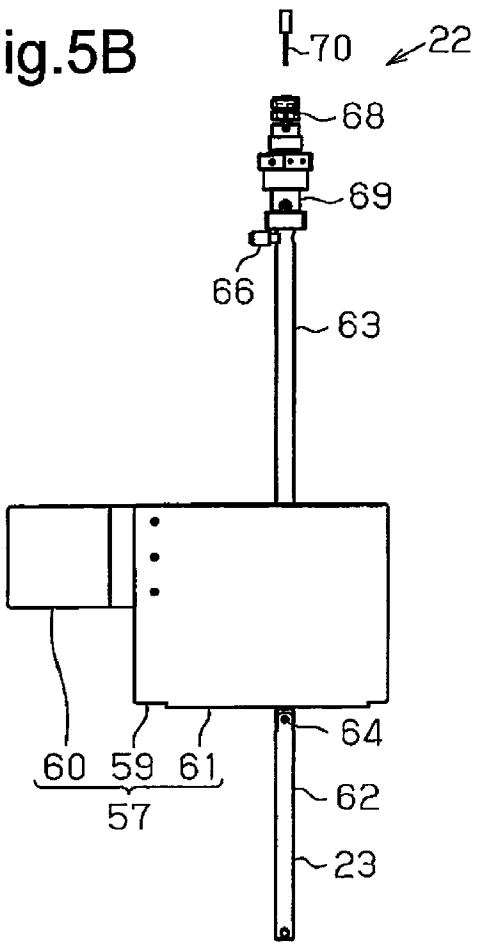
FIG. 5B is a plan view.
Figure 5A:
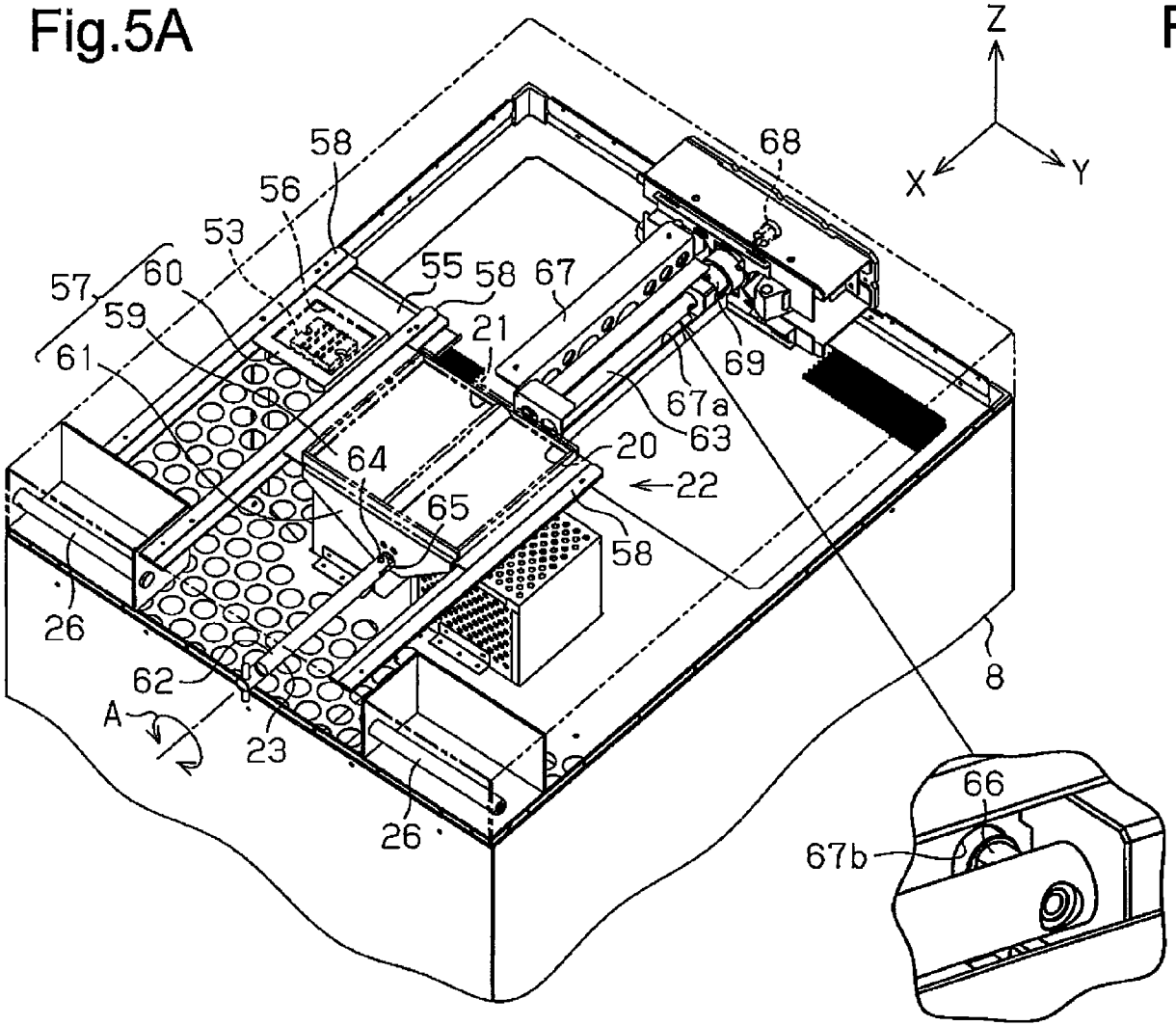
FIG. 5A is a perspective view.
Figure 6B:
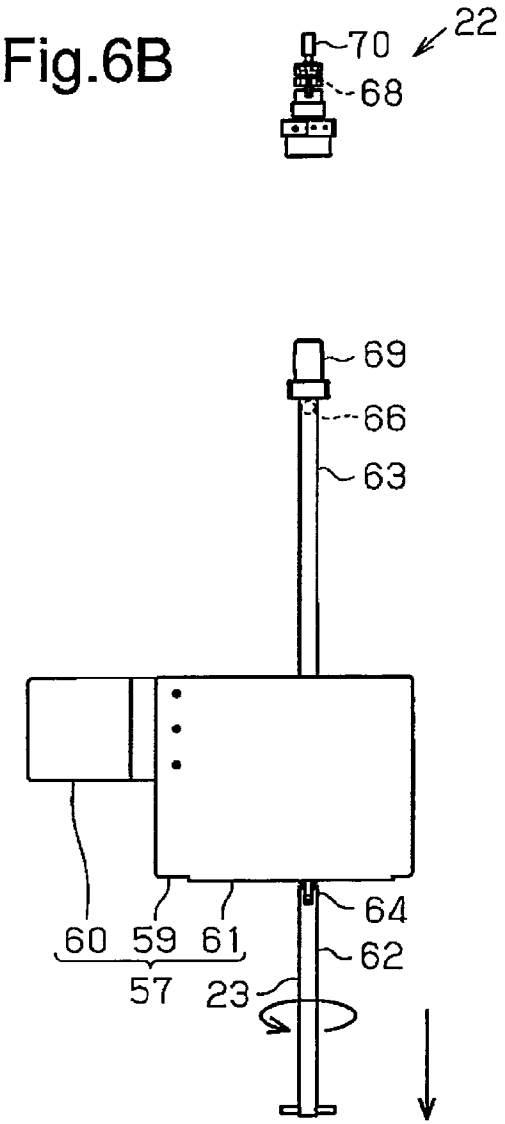
FIG. 6B is a plan view.
Figure 6A:
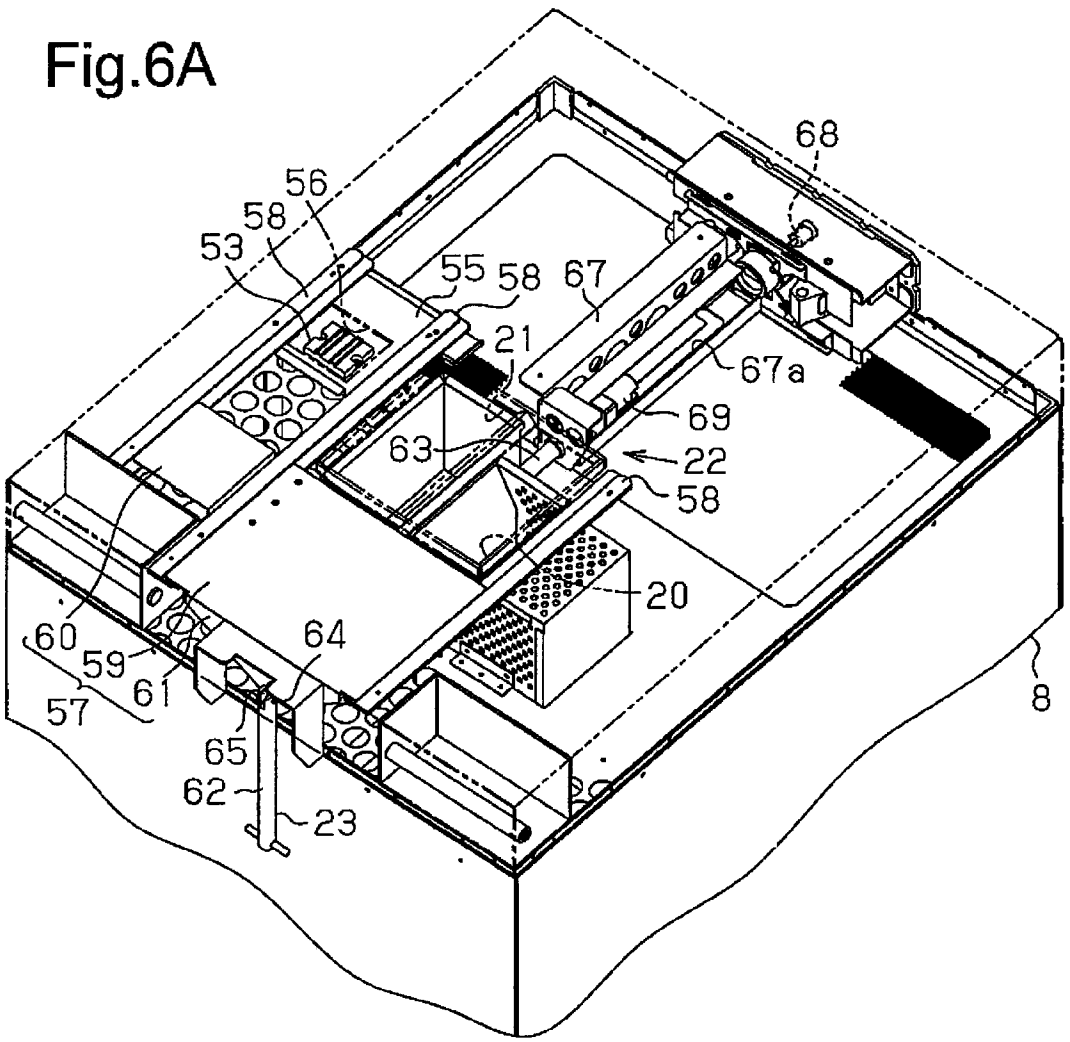
FIG. 6A is a perspective view.

As shown in FIGS. 5A and 6A, the tag 53 is attached and fixed to a tag attachment plate 55, which is located on a lower surface of an upper wall of the currency container 8. The shutter 22 moves between a closed position, in which the shutter 22 closes and conceals the tag 53, and an open position, in which the shutter 22 is open to expose the tag 53. When the tag 53 is covered by the shutter 22, the shutter 22 blocks the electric wave transmitted from the antenna 54. Thus, the tag 53 cannot receive the electric wave from the antenna 54. Consequently, the tag 53 does not perform the short-distance communication. When the shutter 22 is open, the tag 53 is exposed through an opening 56 in the upper wall of the currency container 8.

The shutter 22 incorporating a lock cannot be opened or closed without an authentic key. In the present example, the lock-incorporated shutter 22 has a structure that is basically the same as the lock-incorporated safe door 14. For example, the lock-incorporated shutter 22 is coupled to a shield plate 57, which has a generally L-shaped cross section. The shield plate 57 is slidable in a depthwise direction of the currency container 8 (X-axis direction of FIG. 5A) using three guide portions 58 arranged in a widthwise direction of the currency container 8 (X-axis direction of FIG. 5A). The shield plate 57 integrally includes a currency shutter portion 59, which opens and closes the coin inlet 20 and the bill inlet 21, a tag shutter portion 60, which opens and closes the tag 53, and a vertical plate portion 61 arranged orthogonal to the shutter portions 59 and 60.

A movable joint 64 joins a first shaft portion 62, which is located at a front side of the currency container 8, to a second shaft portion 63, which is located at a rear side of the currency container 8, to form the container handle 23. The second shaft portion 63 is attached to a through hole 65 of the vertical plate portion 61 of the shield plate 57. This allows for only rotation of the second shaft portion 63. The container handle 23 moves integrally with the shield plate 57 in the sliding direction (X-axis direction of FIG. 5A). However, only the container handle 23 moves in a rotating direction (direction of the arrow A of FIG. 5).

A restriction portion 66 projects from a location proximal to the second shaft portion 63 to define a range in which the container handle 23 slides and rotates. The currency container 8 includes a guide portion 67, which extend to guide the slide of the container handle 23. The guide portion 67 includes two guide grooves 67*a* and 67*b*, in which the restriction portion 66 moves along. The first guide groove 67*a* is formed to allow the container handle 23 to slide. The second guide groove 67*b* is formed to allow the container handle 23 to rotate.

A cylinder lock 68, which functions as a lock of the shutter 22, is located at the rear of the currency container 8. The structure around the cylinder lock 68 is the same as the lock of the safe door 14 and thus will not be described in detail. A distal end of the second shaft portion 63 includes an engagement recess 69, which is engaged with the cylinder lock 68. When the container handle 23 slides together with the shield plate 57 toward the rear side of the currency container 8 to close the shield plate 57, the engagement recess 69 is inserted into and engaged with a shaft engagement portion at the side of the cylinder lock 68. This allows for integral rotation of the container handle 23 and the cylinder lock 68.

As shown in FIGS. 5A and 5B, when the container handle 23 slides to the front side of the currency container 8, the shutter 22 closes. When a key plate 70 is removed from the cylinder lock 68, the rotation piece (not shown) of the cylinder lock 68 cannot be rotated. Consequently, the container handle 23 cannot be rotated from a fixed position. This locks the shutter 22. In contrast, as shown in FIGS. 6A and 6B, when the key plate 70 is inserted into the cylinder lock 68, for example, by setting the currency container 8 in the container unit 3, the rotation piece of the cylinder lock 68 may be rotated. Consequently, the container handle 23 may be rotated from the fixed position. This unlocks the shutter 22. This allows the shutter 22 to open when the container handle 23 is operated.

Safe Unlocking Machine Electric Configuration

Figure 7:
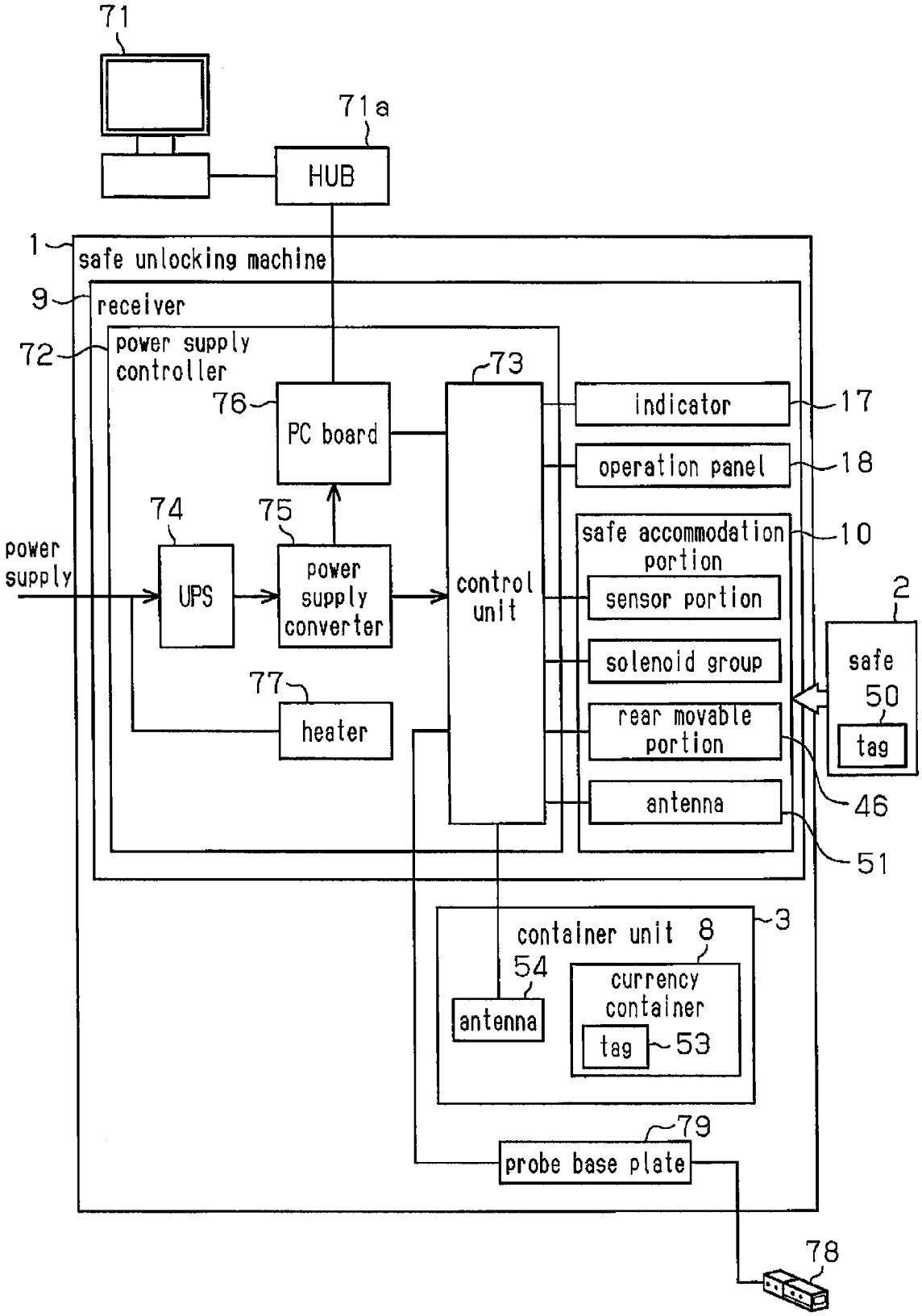
FIG. 7 is an electrical configuration diagram of the safe unlocking machine.

As shown in FIG. 7, the safe unlocking machine 1 is connected to a host computer 71 via a hub 71*a*. A plurality of safe unlocking machines 1 may be connected to the host computer 71 via the hub 71*a*.

The receiver 9 includes a power supply controller 72, which controls the operation of the safe unlocking machine 1. The power supply controller 72 includes a control unit 73, which is a controller of the power supply controller 72, an uninterruptible power supply (UPS) 74, which functions as a power supply during an outage, a power supply converter 75, which converts the power supply (AC: 120V) to a desirable voltage and a desirable current, a PC board 76, on which various circuits are mounted, and a heater 77, which heats the power supply controller 72. The control unit 73 is connected to a sensor group, a solenoid group, the indicator 17, the operation panel 18, the rear movable portion 46, the two antennas 51 and 54, and the like. Connection of the PC board 76 to the hub 71*a* connects the power supply controller 72 to the host computer 71.

The safe unlocking machine 1 includes a probe base plate 79, which is connected to a probe 78. The probe 78 performs bidirectional wireless communication with the farebox, for example, through infrared data association (IrDA). The probe 78 transmits a unlock trigger signal to the farebox so that the safe 2 is removed from the farebox, obtains and provides various data from the farebox to the host computer 71, and obtains and downloads various data from the host computer 71 to the farebox.

The operation of the safe unlocking machine 1 of the present example will now be described with reference to FIGS. 1, 3, 4, and 6.

As shown in FIG. 1, the currency container 8 is set in the container unit 3 when the shutter 22 is closed. Before the currency container 8 is set in the container unit 3, the container handle 23 is moved to the front side of the currency container 8 and rotated by approximately 90 degrees toward the locking side. Thus, the shutter 22, which is locked by the cylinder lock 68, cannot be opened in an unauthorized manner. Additionally, the tag 53 is covered by the shutter 22 (i.e., tag shutter portion 60). This prevents inadvertent verification by the operator.

As shown in FIGS. 6A and 6B, when the currency container 8 is set in the container unit 3, the key plate 70 located in the currency container 8 is inserted into the cylinder lock 68 of the currency container 8. This unlocks the cylinder lock 68 and allows the container handle 23 to be rotated toward the unlocking side.

Then, the container handle 23 is rotated by approximately 90 degrees toward the unlocking side and moved toward the side opposite to the currency container 8. In corporation with this operation, the shutter 22 performs an opening operation. When the container handle 23 is moved toward the side opposite to the currency container 8 until further movement of the container handle 23 is restricted, the shutter 22 opens. This opens the coin inlet 20 and the bill inlet 21 and exposes the tag 53. In this case, in the container handle 23, the movable joint 64 allows only the first shaft portion 62 to be inclined approximately 90 degrees.

As shown in FIGS. 3 and 4, when the power of the safe unlocking machine 1 goes on, the two antennas 51 and 54 start polling operations to monitor whether or not the tags 50 and 53 exist. Therefore, during the transportation of the currency container 8 into the container unit 3, the tag 53 receives a trigger signal from the antenna 54 and transmits its own identification ID to the antenna 54 through load modulation. When receiving the identification ID with the antenna 54, the control unit 73 verifies the identification ID and holds the verification result.

Subsequently, as shown in FIG. 1, the receiver door 12 opens, and the safe 2 is turned upside down to be set in the safe accommodation portion 10. In this case, the key plate 34 located in the safe accommodation portion 10 is inserted into the cylinder lock 33 of the safe 2. This unlocks the cylinder lock 33 and allows the safe handle 29 to be rotated toward the unlocking side. When the safe handle 29 is rotated by approximately 90 degrees toward the unlocking side, the position restriction is cancelled by the safe handle 29. This allows for relative movement of the safe main body 13 and the safe door 14.

After the safe 2 is completely set, the receiver handle 16 is rotated once (approximately 360 degrees). In this case, when the conditions (a) to (e) are all satisfied, the control unit 73 allows the receiver handle 16 to be rotated toward the unlocking side.

(a) The receiver door detection sensor 42 detects that the receiver door is closed.

(b) The safe detection sensor 43 detects that the safe handle 29 has been operated and oriented in the horizontal direction.

(c) The housing door detection sensor 52 detects that the housing door 7 is closed.

(d) The RFID verification has been accomplished between the antenna 54 of the container unit 3 and the tag 53 of the currency container 8.

(e) The home position detection sensor 47 detects that the rear movable portion 46 is located at the home position.

When the control unit 73 determines that conditions (a) to (e) have all been accomplished, the control unit 73 energizes the handle fixing solenoid 44 to unlock the safe handle 29. This allows the safe handle 29 to be rotated. Thus, the safe handle 29 is rotated once.

As shown in FIG. 4, when the safe handle 29 is rotated once, the rear movable portion 46 moves only the safe main body 13 toward the rear side of the receiver 9 while leaving the safe door 14. This downwardly exposes the opening of the safe main body 13. Thus, the currency falls down due to its own weight. As a result, the currency that was in the safe main body 13 is stored in the currency container 8. When the safe main body 13 is moved to the final position, RFID verification is performed between the tag 50 and the antenna 51. When the RFID verification is not accomplished, the indicator 17 indicates an error. Further, when moved to the final position, the safe main body 13 is held by the lock solenoid 49.

When a final position detection sensor 48 detects that the rear movable portion 46 has reached the final position, the control unit 73 uses a timer or the like to measure time elapsed from when the final position is reached. When a predetermined time elapses, the control unit 73 energizes the lock solenoid 49 to unlock the rear movable portion 46. The predetermined time, which is the time estimated for all of the currency to fallen after the rear movable portion 46 is moved to the final position. Then, the rear movable portion 46 moves toward the home position. In accordance with this operation, the safe main body 13 also slides to the home position. The safe door 14 closes the safe main body 13.

When checking that the safe main body 13 has returned to the home position, the operator opens the receiver door 12 and removes the empty safe 2. The operator repeatedly performs the above operations on each of the safes 2 storing currency. The safe unlocking machine 1 collects the currency in a centralized manner from each of the safes 2. Subsequently, the currency container 8 is removed from the safe unlocking machine 1 and transported to a currency collection room (not shown). In the currency collection room, the currency is removed from the currency container 8.

Accordingly, the present embodiment has the advantages described below.

(1) Short-distance communication (RFID verification) is used to verify the currency container 8. Thus, the authenticity of the currency container 8 may be checked through a non-contact procedure. This eliminates the need for contact between the safe unlocking machine 1 and the currency container 8 during verification. Thus, the durability of the currency container 8 may be ensured.

(2) The tag 53 has a water resistant structure. This also ensures the water resistance of the currency container 8.

(3) The tag 53 does not need a power supply. Thus, there is no need to install various components, such as a power supply, a motor, and a sensor, in the currency container 8. This simplifies the structure of the currency container 8 and ensures the reliability of the currency container 8.

(4) The shutter 22 opens and closes the tag 53. By closing the shutter 22, verification is not performed unless the operator intends to do so. This prevents unauthorized verification communication.

(5) The currency shutter portion 59 is arranged integrally with the tag shutter portion 60. Thus, the opening and closing of the tag 53 may be performed in cooperation with the opening and closing of the coin inlet 20 and the bill inlet 21. Therefore, a single opening or closing operation may switch open and closed states of both the tag 53 and the coin and bill inlets 20 and 21. This improves convenience.

(6) When the currency container 8 is set in the container accommodation portion 5, if the shutter 22 is closed, the RFID verification is not accomplished. This does not satisfy the condition to permit the operation of the receiver handle 16. Thus, the receiver handle 16 cannot be rotated. Therefore, when the shutter 22 of the currency container 8 is closed, the currency will not be discharged out of the safe 2 and into the currency container 8, that is, the currency will not be piled on the shutter 22.

(7) When the power of the safe unlocking machine 1 goes on, the antenna 54 starts the polling operation. Thus, when setting the currency container 8 in the container accommodation portion 5, the verification is automatically performed when the tag 53 approaches the antenna 54. Therefore, when setting the currency container 8 in the container accommodation portion 5, the operator does not have to perform an additional operation to verify the tag 53.

The embodiment is not limited to the above configurations. The embodiment may be modified as follows.

The currency shutter portion 59 may be separated from the tag shutter portion 60.

The lock-incorporated shutter 22 may have a structure in which the operator inserts a key into the cylinder lock and turns the key to open and close the shutter 22.

The shutter 22 may be electrically opened or closed.

The currency container 8 may be modified to a structure differing from the above embodiments.

The short-distance communication may employ another communication method, such as near field communication (NFC).

The polling cycle of the short-distance communication may be variable. For example, when the verification is accomplished, the interval of the polling may be extended.

The RFID verification of the tag 53 (timing to start the polling) may be started, for example, when the currency container 8 is set in the container unit 3.

The location of the antenna 54 may be changed to a different location, such as in the receiver 9.

The location of the tag 53 is not limited to the surface of the currency container 8 where the currency inlet is located. The tag 53 and the currency inlet may be located on different surfaces.

The tag 53 may store the time when the RFID verification of the tag 53 is started and ended. This allows a computer system to receive and control the time via the tag 53 when the currency container 8 is moved into and out of the container accommodation portion 5.

The safe unlocking machine 1 may read and count the amount of money stored in the safe 2 from the tag 50 to store the total amount of the collected money in the tag 53. In the currency collection room, the verification of the tag 53 is performed by a RFID reader-writer, which is connected to a currency collection computer system, to remove the currency from the currency container 8. The tag 53 is initialized after reading the total amount of the money collected in the currency container 8.

When the currency is removed from the currency container 8 in the currency collection room, an empty flag may be written to the tag 53 to indicate that the currency has been removed from the currency container 8. When the currency container 8 is attached to the safe unlocking machine 1, if the empty flag is read from the tag 53, operations are performed as usual. If the empty flag is not read from the tag 53, there is an error and the safe unlocking machine 1 is not operated. When the safe unlocking machine 1 is operated in a normal manner and the currency container 8 collects the currency from the safe 2, the empty flag is deleted from the tag 53. This limits reuse of the currency container 8 when currency still remains therein. Thus, only an empty currency container 8 may be set in the safe unlocking machine 1. This avoids a situation in which the collected currency exceeds the capacity of the currency container 8.

The receiver 9 may be modified to a different structure, for example, the receiver 9 may have a structure that does not rotate the receiver handle 16.

The condition for opening the safe door 14 of the safe 2, which is set in the safe unlocking machine 1, may be modified as long as at least the accomplishment of the RFID verification on the tag 53 of the currency container 8 is included.

The structure of the safe 2 may be modified as long as the safe door 14 incorporates a lock.

The actuators and detectors located in the safe unlocking machine 1 may be modified to different types.

Articles stored in the safe 2 include at least one of coins, bills, tickets, and the like.

The invention claimed is:

1. A safe unlocking machine that receives a safe, which stores a stored article, unlocks the safe, and opens a door of the safe to collect the stored article from the safe, the safe unlocking machine comprising:

a storage container;

a safe unlocking machine main body configured to receive the storage container;

a verification unit that performs verification between the storage container and the safe unlocking machine main body through short-distance communication; and a control unit that permits the stored article to be collected in the storage container when the verification performed by the verification unit is accomplished;

wherein the verification unit includes a tag that is located in the storage container and performs the short-distance communication, and the storage container includes a lock-incorporated shutter that opens and closes so that the tag can be concealed and exposed.

2. The safe unlocking machine according to claim 1 wherein the storage container includes an opening, through which the stored article is movable, the lock-incorporated shutter includes a lock portion that locks the shutter, wherein the lock portion is unlocked when the storage container is set in the safe unlocking machine main body, a first shutter portion moved between an open position to open the opening and a closed position to close the opening, a second shutter portion that is arranged integrally with the first shutter portion and moved between a concealing position to conceal the tag and an exposure position to expose the tag, and an operation unit configured to be capable of operating to move the first and second shutter portions, wherein the operation unit is operable when the lock portion is unlocked.

3. The safe unlocking machine according to claim 2 comprising:

a safe door operation unit configured to be capable of operating to open the door of the safe, and a lock member that restricts the operation of the safe door operation unit, wherein when the verification is accomplished, the control unit cancels the restriction of the lock member to allow the door to open when operated by the safe door operation unit.

* * * * *